US011659316B2

(12) United States Patent
Akaike

(10) Patent No.: US 11,659,316 B2
(45) Date of Patent: May 23, 2023

(54) ACOUSTIC DEVICE AND METHOD FOR CONTROLLING ACOUSTIC DEVICE

(71) Applicant: SONY CORPORATION, Tokyo (JP)

(72) Inventor: Kazuhiro Akaike, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 17/250,680

(22) PCT Filed: Jul. 18, 2019

(86) PCT No.: PCT/JP2019/028289

§ 371 (c)(1),
(2) Date: Feb. 18, 2021

(87) PCT Pub. No.: WO2020/044839

PCT Pub. Date: Mar. 5, 2020

(65) Prior Publication Data

US 2021/0306732 A1 Sep. 30, 2021

(30) Foreign Application Priority Data

Aug. 31, 2018 (JP) ..... JP2018-162786

(51) Int. Cl.
*H04R 1/10* (2006.01)
*H04R 5/033* (2006.01)
*H04R 5/04* (2006.01)

(52) U.S. Cl.
CPC ..... *H04R 1/1041* (2013.01); *H04R 5/033* (2013.01); *H04R 5/04* (2013.01)

(58) Field of Classification Search
CPC ..... H04R 1/1041; H04R 5/033; H04R 5/04
(Continued)

(56) References Cited

U.S. PATENT DOCUMENTS 4,513,183 A * 4/1985 Hill ..... H01H 35/02 200/61.83
5,991,085 A * 11/1999 Rallison ..... G02B 27/0176 359/630
(Continued)

FOREIGN PATENT DOCUMENTS

JP 08-195997 A 7/1996
JP 2004-153350 A 5/2004
(Continued)

OTHER PUBLICATIONS

International Search Report and Written Opinion of PCT Application No. PCT/JP2019/028289, dated Sep. 10, 2019, 08 pages of ISRWO.

*Primary Examiner* — Paul Kim
*Assistant Examiner* — Con P Tran
(74) *Attorney, Agent, or Firm* — Chip Law Group

(57) ABSTRACT

An acoustic device according to the present technology includes an operating portion and a control unit. The operating portion generates information for determining whether a state of an earphone portion is a wearing state in which the earphone portion is worn by the user, or a non-wearing state in which the earphone portion is not worn by the user. The control unit determines whether the earphone portion is in the wearing state or in the non-wearing state on the basis of output from the operating portion, and implements a function based on a result of the determination.

8 Claims, 8 Drawing Sheets

(58) Field of Classification Search
USPC ..... 381/74, 58, 111, 380, 71.1, 71.8, 122; 340/689; 200/61.52
See application file for complete search history.

(56) References Cited

U.S. PATENT DOCUMENTS

| | | | | |
|---|---|---|---|---|
| 2009/0290720 | A1 | 11/2009 | Johnson | |
| 2013/0121494 | A1* | 5/2013 | Johnston | H04R 1/1041 381/56 |
| 2017/0123047 | A1* | 5/2017 | Rosener | G01S 5/16 |
| 2018/0270565 | A1* | 9/2018 | Ganeshkumar | G10L 25/84 |

FOREIGN PATENT DOCUMENTS

| | | | | |
|---|---|---|---|---|
| JP | 2004153350 | A | * | 5/2004 |
| JP | 2009-514296 | A | | 4/2009 |
| JP | 2009-207053 | A | | 9/2009 |
| WO | 2007/049075 | A1 | | 5/2007 |

* cited by examiner

ACOUSTIC DEVICE AND METHOD FOR CONTROLLING ACOUSTIC DEVICE

CROSS REFERENCE TO RELATED APPLICATIONS

This application is a U.S. National Phase of International Patent Application No. PCT/JP2019/028289 filed on Jul. 18, 2019, which claims priority benefit of Japanese Patent Application No. JP 2018-162786 filed in the Japan Patent Office on Aug. 31, 2018. Each of the above-referenced applications is hereby incorporated herein by reference in its entirety.

TECHNICAL FIELD

The present technology relates to an acoustic device to be used in listening to music and the like, and a method for controlling this acoustic device.

BACKGROUND ART

Hitherto, as well known, acoustic devices such as earphones and headphones are not always fitted to earholes. Even if sound is played back in such a state, a user cannot listen to the sound, and power of the acoustic devices is wasted.

In order to solve this problem, according to the technology disclosed in Patent Literature 1, whether the earphones are in a fitting state of being fitted to the earholes, or in a non-fitting state of not being fitted to the earholes is detected by contact switches, and the sound is played back on the basis of results of the detection. With this, for example, processes in accordance with the fitting states of the acoustic devices, such as a process of stopping the sound playback in the non-fitting state, are automatically executed. As a result, the power is supposed to be prevented from being wasted.

CITATION LIST

Patent Literature

Patent Literature 1: Japanese Patent Application Laid-open No. 2004-153350

DISCLOSURE OF INVENTION

Technical Problem

However, the technology disclosed in Patent Literature 1 is disadvantageous in that the contact switches need to be provided in the earphone portion to detect the fitting state and the non-fitting state of the earphones, and in that the number of components to prevent the waste of the power needs to be increased in the earphone portion.

In view of such circumstances, the present technology has been made to achieve an object to provide an acoustic device that is capable of reducing power consumption even without increasing the number of components in an earphone portion, and a method for controlling this acoustic device.

Solution to Problem

In order to achieve the above-mentioned object, according to an embodiment of the present technology, there is provided an acoustic device including an operating portion and a control unit.

The operating portion generates information for determining whether a state of an earphone portion is a wearing state in which the earphone portion is worn by the user, or a non-wearing state in which the earphone portion is not worn by the user.

The control unit determines whether the earphone portion is in the wearing state or in the non-wearing state on the basis of output from the operating portion, and implements a function based on a result of the determination.

The control unit may implement, in accordance with a determined one of the wearing state and the non-wearing state of the earphone portion, a wearing function in the wearing state, and a non-wearing function in the non-wearing state.

The control unit may implement a noise cancelling function as the wearing function. This enables the user to listen to sound from which the noise is removed, and to have a realistic sense of immersion.

The control unit may implement an energy-saving function as the non-wearing function. This prevents the sound from being played back under the state in which the earphone portion is not worn by the user. Thus, power consumption can be reduced. In addition, in this case, for example, if the noise cancelling function is being implemented, by stopping this function, power consumption can be further reduced.

The operating portion may include a detection unit for determining whether the earphone portion is in the wearing state or in the non-wearing state. With this, a size of the earphone portion can be reduced to be smaller than that in a case where the earphone portion includes the built-in detection unit, and the number of wires (core wires) connecting the earphone portion and the operating portion to each other can be reduced. Thus, the acoustic device can be configured even without increasing the number of components in the earphone portion.

The operating portion may be provided at a position near the earphone portion. With this, whether the earphone portion is in the wearing state or in the non-wearing state can be clearly distinguished. As a result, false detection of the state of the earphone portion is suppressed.

The operating portion may include a tilt sensor as the detection unit. With this, power need not be separately supplied to the tilt sensor itself. Thus, power consumption and the number of wires (core wires) can be reduced to be smaller than those in utilizing other sensors.

In order to achieve the above-mentioned object, according to another embodiment of the present technology, there is provided a method for controlling an acoustic device, the method including:

determining whether a state of an earphone portion is a wearing state in which the earphone portion is worn by the user, or a non-wearing state in which the earphone portion is not worn by the user; and implementing, in accordance with a determined one of the wearing state and the non-wearing state of the earphone portion, a wearing function in the wearing state, and a non-wearing function in the non-wearing state.

Advantageous Effects of Invention

As described above, according to the present technology, the acoustic device that is capable of reducing power consumption even without increasing the number of components in the earphone portion, and the method for controlling this acoustic device can be provided. Note that, the above-described advantages should not be construed restrictively. Together with the above-described advantages or instead of the above-described advantages, any of the advantages described herein or other advantages that can be understood from the present application may be obtained.

MODE(S) FOR CARRYING OUT THE INVENTION

Hereinbelow, with reference to the drawings, an embodiment of a case where the present technology is applied to Bluetooth (trademark) earphones is described.

[Configuration of Acoustic Device]

Figure 1:
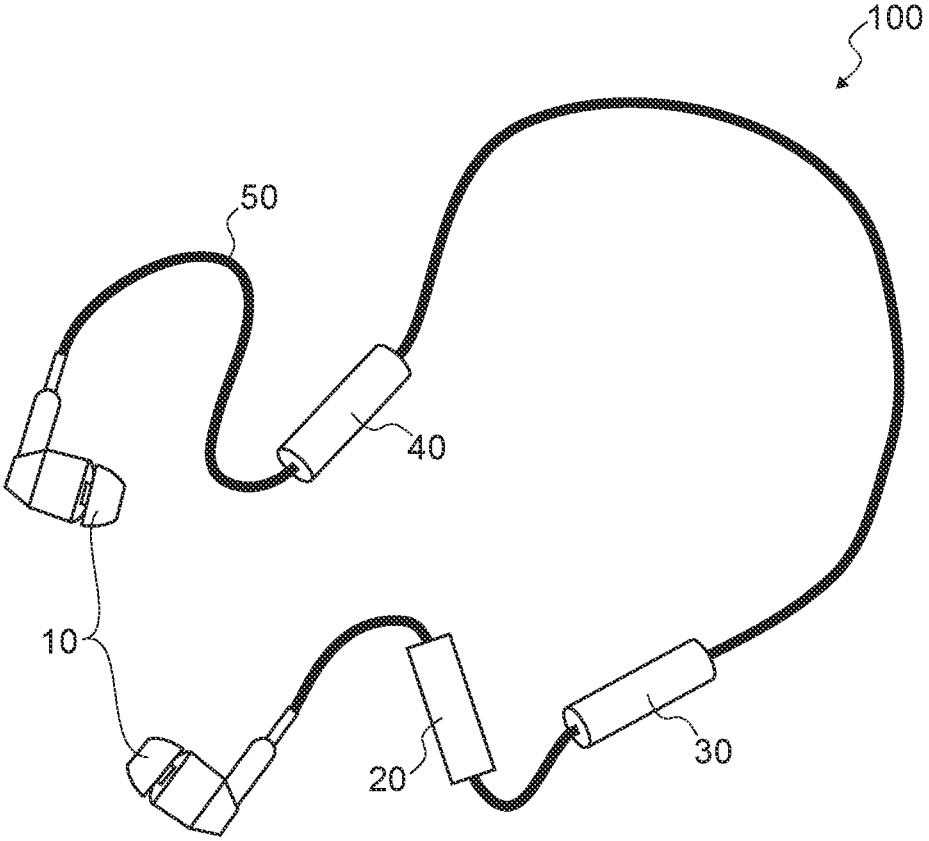
FIG. 1 A schematic view illustrating a configuration example of an acoustic device of the present technology.
Figure 2:
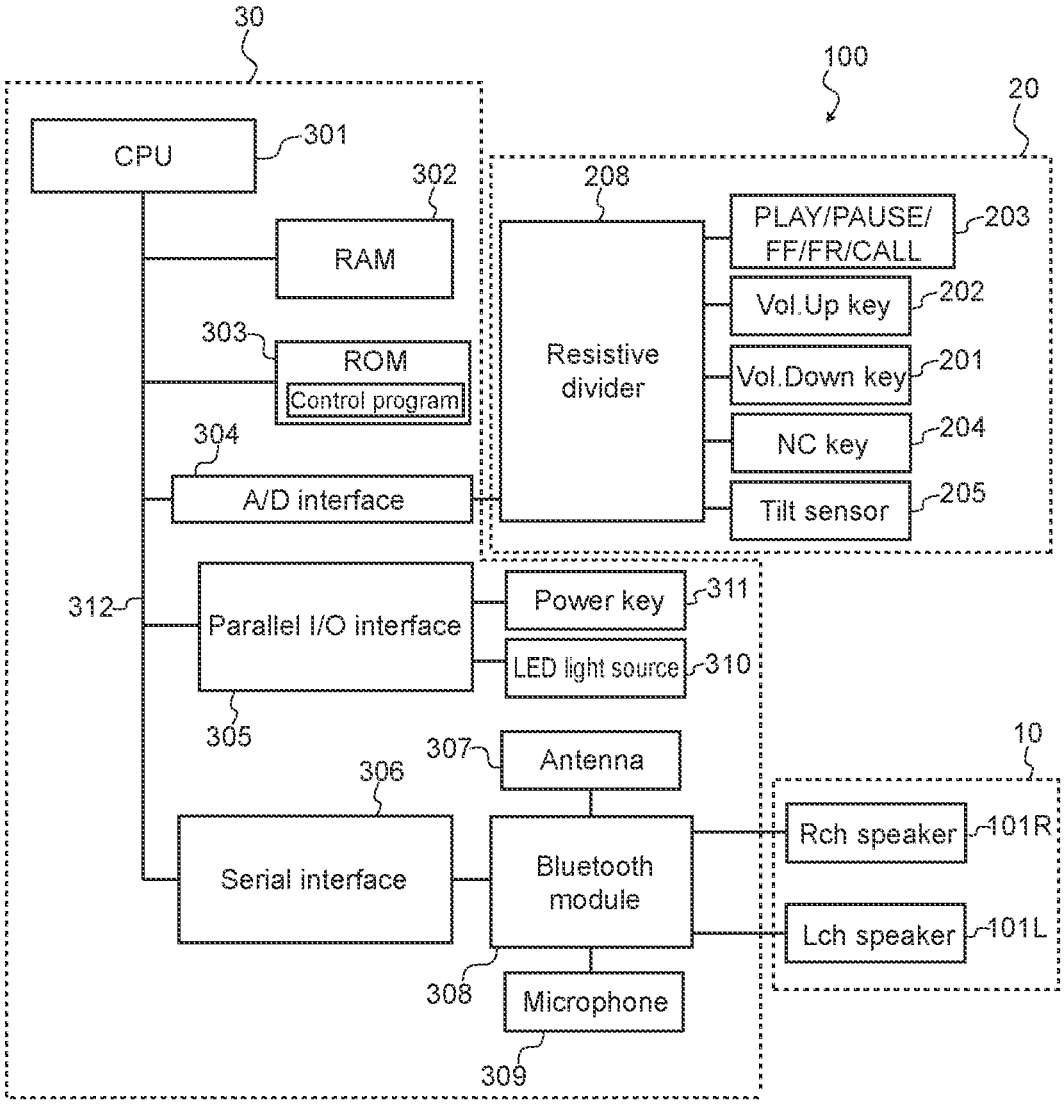
FIG. 2 A block diagram illustrating a configuration example of the acoustic device.

FIG. 1 is a schematic view illustrating a configuration example of an acoustic device 100 of the present technology. FIG. 2 is a block diagram illustrating a configuration example of the acoustic device 100. As illustrated in FIG. 1, the acoustic device 100 includes an earphone portion 10, a remote-control portion 20 (operating portion), a main-unit portion 30, a battery portion 40, and a cable 50.

(Earphone Portion)

The earphone portion 10 is connected to the cable 50, specifically, is connected electrically to the remote-control portion 20 and the battery portion 40 via the cable 50. A right-hand earphone of the earphone portion 10 includes a built-in Rch speaker 101R, and a left-hand earphone of the same includes a built-in Lch speaker 101L.

The Rch speaker 101R and the Lch speaker 101L are connected to a Bluetooth (trademark) module 308, and are configured to output sound by converting an electrical signal acquired via this module 308 to air vibration (sound). Note that, "R" and "L" in the reference symbols respectively represent the right and left as viewed from a user wearing the acoustic device 100.

(Remote-Control Portion)

The remote-control portion 20 is connected to the cable 50, specifically, is connected electrically to the earphone portion 10 and the main-unit portion 30 via the cable 50. The remote-control portion 20 of this embodiment is provided between the earphone portion 10 and the main-unit portion 30, specifically, at a position near the earphone portion 10.

Figure 3:
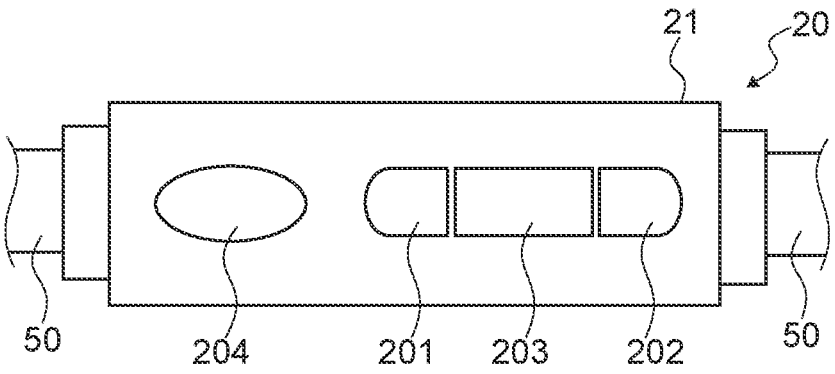
FIG. 3 An enlarged schematic view of the remote-control portion of the acoustic device.

FIG. 3 is an enlarged schematic view of the remote-control portion 20. The remote-control portion 20 includes a casing 21 and a resistive divider 208 built in the casing 21. Although a material of the casing 21 is not limited in particular, typically, the casing 21 is made of a synthetic resin such as plastic.

Figure 4:
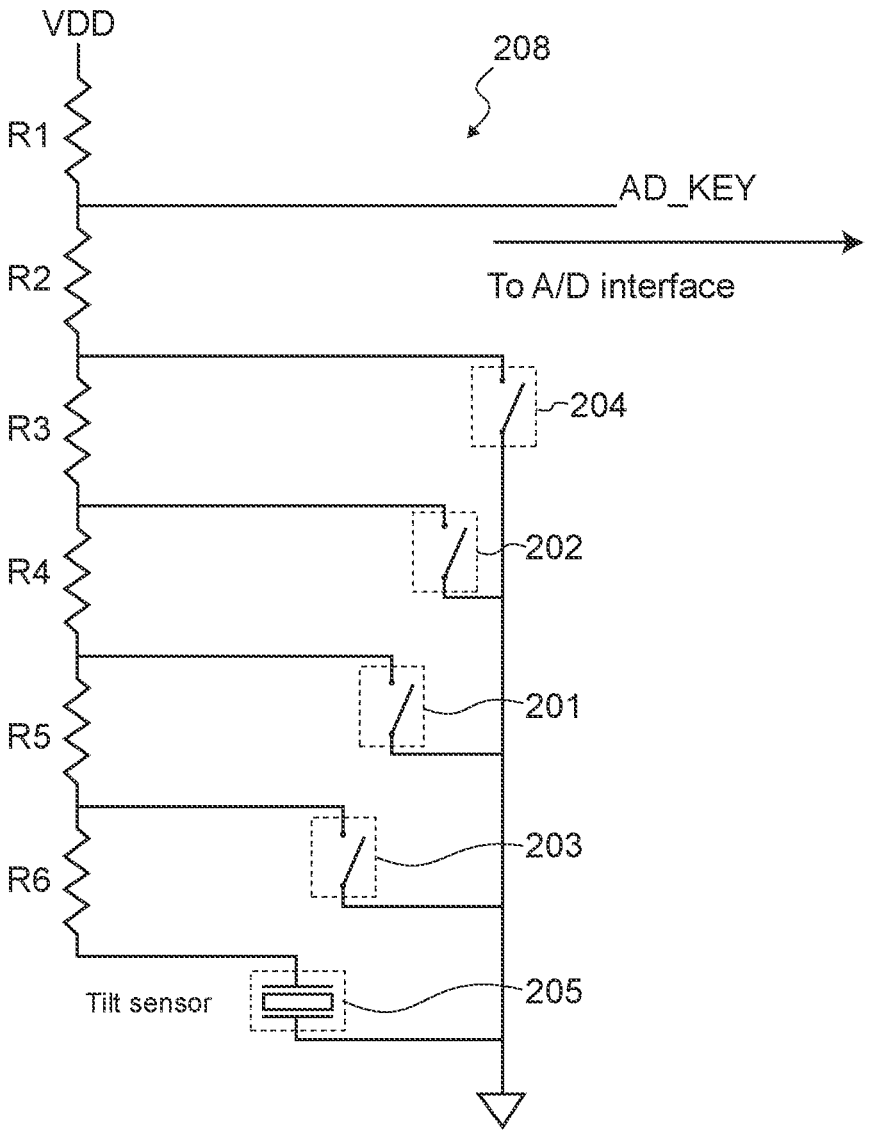
FIG. 4 A circuit diagram showing an example of a resistive divider of the remote-control portion.

FIG. 4 is a circuit diagram showing an example of the resistive divider 208. The resistive divider 208 is an analog circuit including resistors R1 to R6 connected in series. The resistive divider 208 includes a PLAY/PAUSE/FF/FR/CALL key 203, a Vol.Up key 202, a Vol.down key 201, an NC (Noise Cancelling) key 204, and a tilt sensor (detection unit). The resistive divider 208 outputs output currents (analog signals) based on various different output voltages according to the resistive divider rule to the main-unit portion 30 (A/D interface 304).

When the user presses the PLAY/PAUSE/FF/FR/CALL key 203, sound is played back, stopped, paused, fast-forwarded, or rewound under control by a CPU 301. When the user presses the Vol.Up key 202 and the Vol.down key 201, volume of the sound to be output from the earphone portion 10 is increased or reduced under the control by the CPU 301.

In addition, when the user presses the NC key 204, the CPU 301 implements a noise cancelling function (NC function) to reduce nose by generating an acoustic wave component in a phase reverse to that of noise picked up by microphones in the earphone portion 10.

The tilt sensor 205 is configured to be capable of detecting a tilt of the acoustic device 100 (remote-control portion 20). The tilt sensor 205 includes, for example, a built-in metal ball. When the tilt sensor 205 is tilted in a certain direction, the ball comes into contact with a metal terminal to establish conduction between a power supply (VDD) and the ground. When the tilt sensor 205 is tilted to an opposite side, the ball and the metal terminal separate from each other to insulate the power source and the ground. An example of such a configuration of the tilt sensor 205 is disclosed, for example, in Japanese Patent Application Laid-open No. 2000-173420 (refer to FIG. 6).

Although a type of the tilt sensor 205 is not limited in particular, typically, a one-directional tilt type in which the ball rolls in a certain direction is employed. Note that, the exemplary circuit diagram of FIG. 4 is that of a case where the tilt sensor 205 is incorporated in the resistive divider 208.

Figure 5:
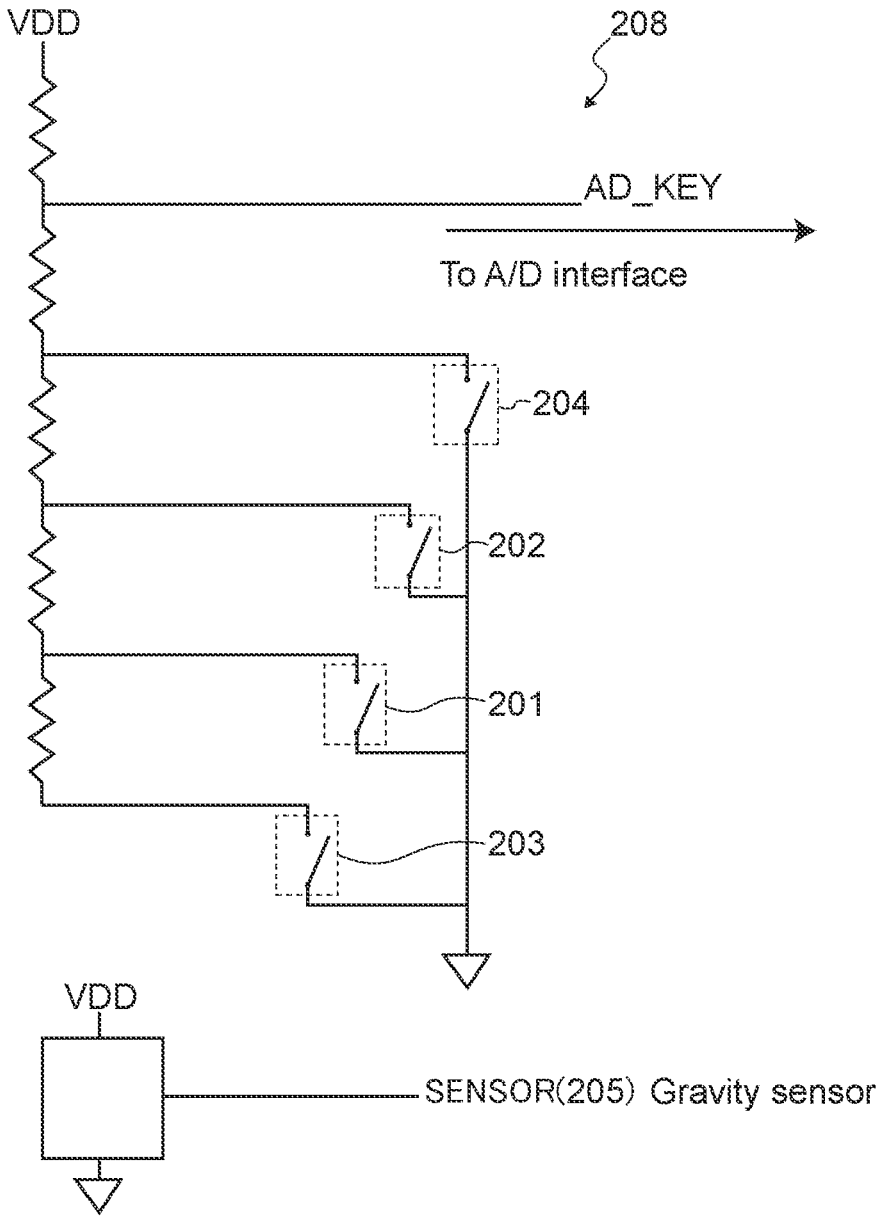
FIG. 5 A circuit diagram showing another example of the resistive divider of the remote-control portion.

The tilt sensor 205 need not necessarily be incorporated in the resistive divider 208 as in this embodiment, and a gravity sensor may be incorporated instead of the tilt sensor 205. FIG. 5 is a circuit diagram showing an example in which the gravity sensor is incorporated in the resistive divider 208. A type of the gravity sensor is not limited, and, for example, a three-axis acceleration sensor that measures acceleration in three-axis directions orthogonal to each other, or the like may be used.

Note that, as a matter of course, a configuration of the remote-control portion 20 is not limited to the configuration illustrated in FIG. 3, and sizes, shapes, arrangements, and the like of the various keys may be changed as appropriate.

(Main-Unit Portion)

The main-unit portion 30 is connected to the cable 50, specifically, is connected to the remote-control portion 20 and the battery portion 40 via the cable 50. As shown in FIG. 2, the main-unit portion 30 includes the CPU (Central Processing Unit) 301 (control unit), a RAM (Random Access Memory) 302, a ROM (Read Only Memory) 303, the A/D interface 304 (A/D converter), a parallel I/O interface 305, a serial interface 306, an antenna 307, a Bluetooth (trademark) module 308, a microphone 309, an LED light source 310, a power key 311, and a bus 312.

The CPU 301 functions as an arithmetic processing device and a control device, and controls all or ones of operations of the acoustic device 100 in accordance with various programs stored in the RAM 302 or the ROM 303. The CPU 301 is configured to be capable of implementing a wearing function to be implemented when the acoustic device 100 (earphone portion 10) is worn by the user, and a non-wearing function to be implemented when the acoustic device 100 (earphone portion 10) is not worn by the user.

The CPU 301 is connected to the RAM 302, the ROM 303, the A/D interface 304, the parallel I/O interface 305, and the serial interface 306 via the bus 312.

The CPU 301 of this embodiment performs the control on the basis of various output voltages generated by dividing by the resistive divider 208. Specifically, on the basis of the various output voltages generated by the dividing by the resistive divider 208, the CPU 301 determines which of the keys is pressed, and performs the control in response to operations to the various keys.

In addition, on the basis of the output from the remote-control portion 20 (resistive divider 208), the CPU 301 determines whether or not the acoustic device 100 (earphone portion 10) is worn by the user.

The acoustic device 100 of this embodiment may include, instead of or together with the CPU 301, a processing circuit such as a DSP (Digital Signal Processor), an ASIC (Application Specific Integrated Circuit), or an FPGA (Field-Programmable Gate Array).

The RAM 302 temporarily stores, for example, the programs to be executed by the CPU 301, and parameters to vary as appropriate in accordance with the execution. The ROM 303 stores, for example, the programs and arithmetic parameters to be used by the CPU 301.

The A/D interface 304 is an electronic circuit that is connected to the resistive divider 208, converts the output currents (analog signals) output from the resistive divider 208 to digital signals, and then outputs these signals to the CPU 301.

The parallel I/O interface 305 is connected to the power key 311 and the LED light source 310. The parallel I/O interface 305 is a connection interface configured to be capable of transmitting a plurality of signals in parallel to and simultaneously with each other.

The serial interface 306 is connected to the Bluetooth (trademark) module 308. The serial interface is a connection interface of a serial-transfer-type connection interface that exchanges data via a single signal line.

The antenna 307 receives radio waves from an arbitrary device synchronized with (connected to) the Bluetooth (trademark) module 308, such as a smartphone.

The Bluetooth (trademark) module 308 is a module that is connected to the antenna 307, the microphone 309, the Rch speaker 101R, the Lch speaker 101L, and the serial interface 306, and that performs wireless communication with the arbitrary device such as the smartphone by utilizing the radio waves.

The Bluetooth (trademark) module 308 converts the radio waves received by the antenna 307 to a digital signal, and outputs this signal to the CPU 301. In addition, the Bluetooth (trademark) module 308 converts an electrical signal output from the microphone 309 to the digital signal, and outputs this signal to the CPU 301.

The microphone 309 is configured to be capable of acquiring sound information (such as voice of the user and the like). The microphone 309 converts this sound information to the electrical signal, and outputs this signal to the Bluetooth (trademark) module 308.

The LED light source 310 is connected to the parallel I/O interface 305, and is connected to the bus 312 via this interface. Under the control by the CPU 301, the LED light source 310 emits light when the acoustic device 100 is activated, and is turned off when the acoustic device 100 is deactivated. The LED light source 310 indicates states of the acoustic device 100 by being turned on, turned off, or flashing.

A type of the LED light source 310 is not limited, and, for example, a through-hole type, a Flux type, an SMD (Surface Mount Device) type, a COB (Chip On Board) type, or the like may be employed.

The power key 311 in the main-unit portion 30 is connected to the parallel I/O interface 305, and is connected to the bus 312 via this interface. The power key 311 is a key for activating or deactivating the acoustic device 100.

(Battery Portion)

The battery portion 40 is connected to the cable 50, specifically, is connected to the earphone portion 10 and the main-unit portion 30 via the cable 50. The battery portion 40 is configured to be capable of accumulating a power supply for operating the acoustic device 100, and of supplying the power to the acoustic device 100. As the battery portion 40, rechargeable batteries such as a lithium-ion battery are employed.

(Cable)

The cable 50 contains wires (not shown) that electrically connect the earphone portion 10 and the battery portion 40 to each other, the battery portion 40 and the main-unit portion 30 to each other, the main-unit portion 30 and the remote-control portion 20 to each other, and the remote-control portion 20 and the earphone portion 10 to each other. With this, the earphone portion 10, the remote-control portion 20, the main-unit portion 30, and the battery portion 40 are electrically connected to each other via the cable 50.

Figure 9:
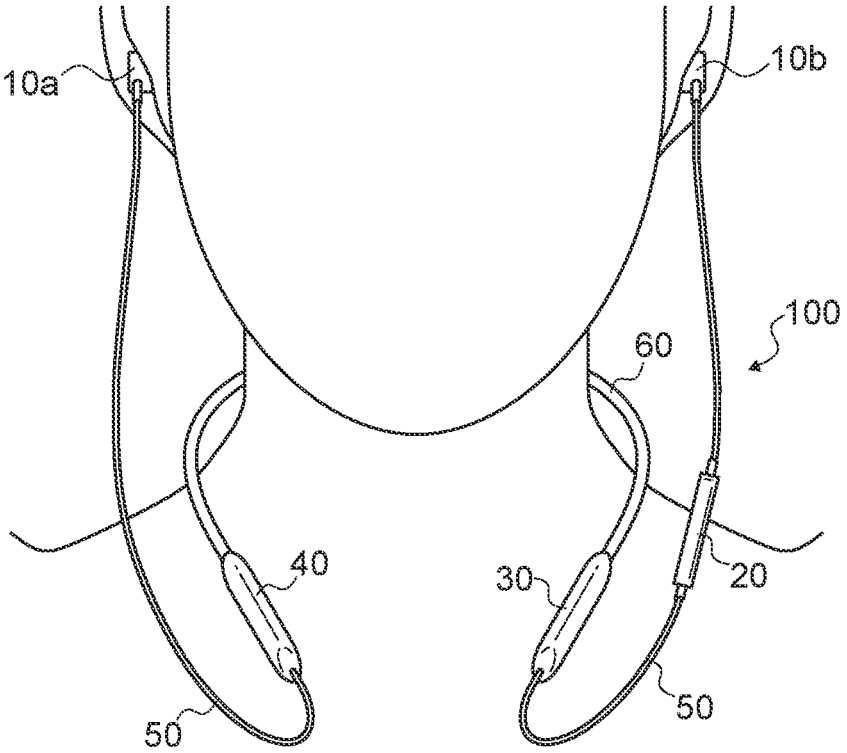
Figure 10:
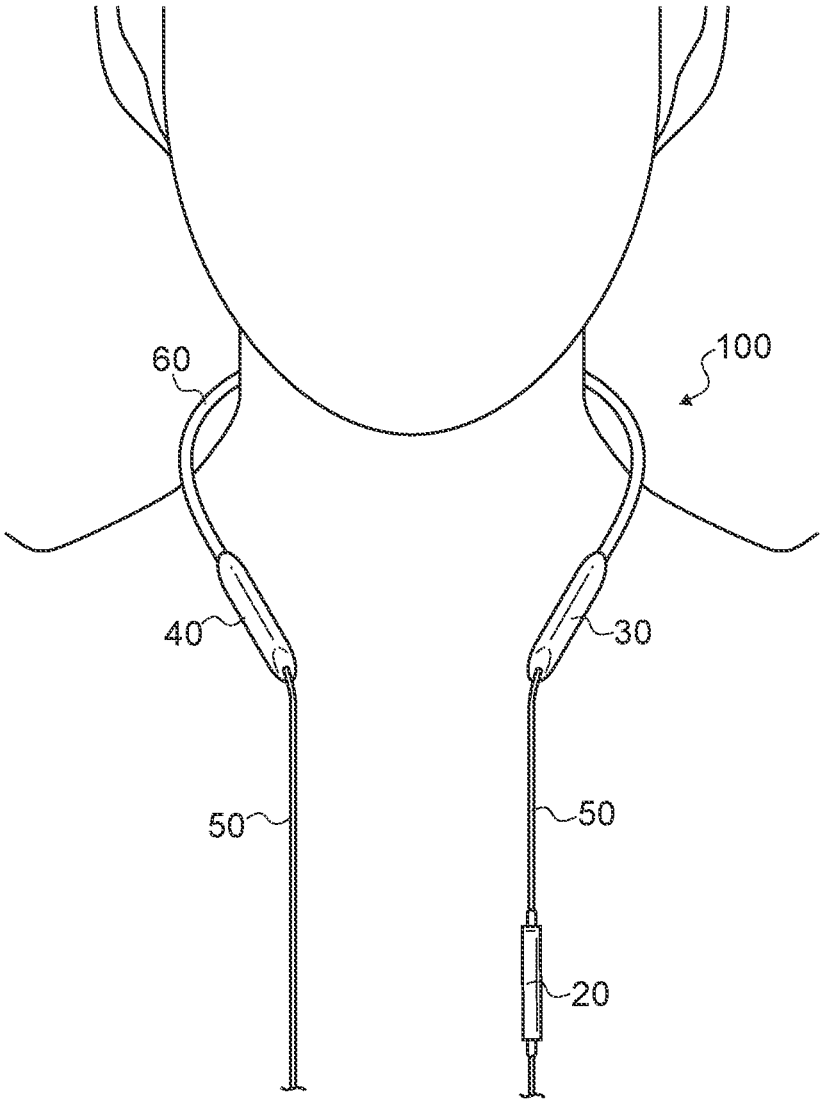
FIG. 10 A view illustrating a non-wearing state in which the acoustic device is not worn by the user.

In this embodiment, the cable 50 may be configured to be contained in a band portion 60 between the main-unit portion 30 and the battery portion 40 (refer to FIG. 9 and FIG. 10).

The band portion 60 is configured to be wrapped around the neck of the user, and, for example, has flexibility of being curved substantially with a predetermined curvature as a whole. Although a material of the band portion 60 is not limited in particular, for example, a synthetic resin or the like is employed.

[Other Configurations of Acoustic Device]

Figure 6:
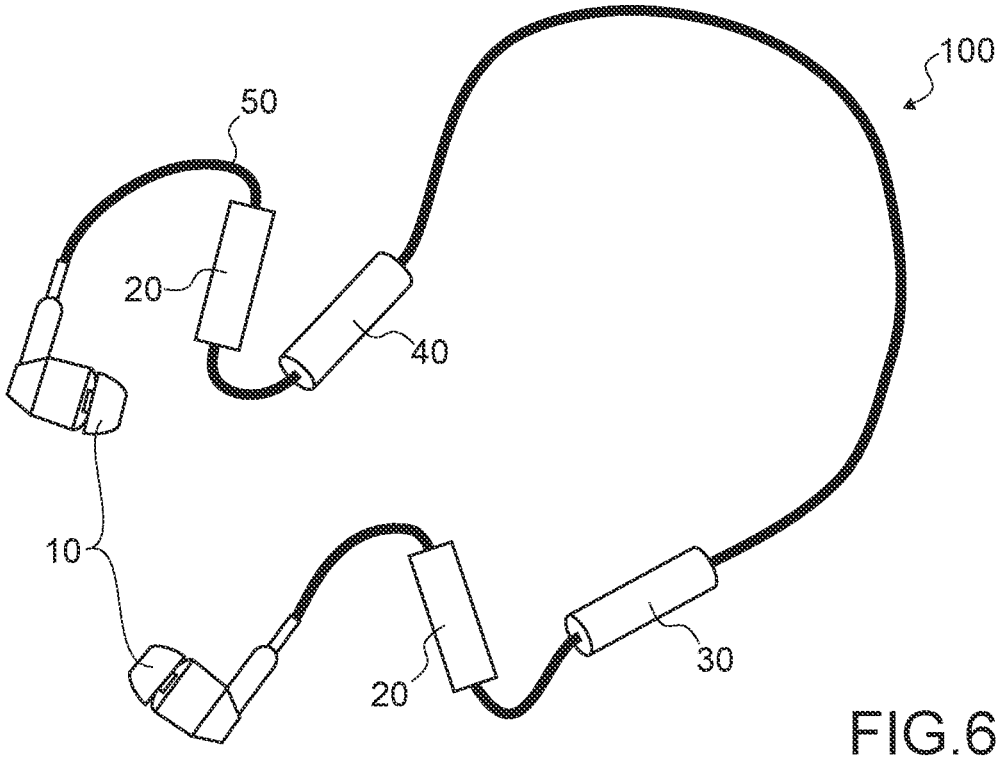
FIG. 6 A schematic view illustrating another configuration example of the acoustic device.
Figure 7:
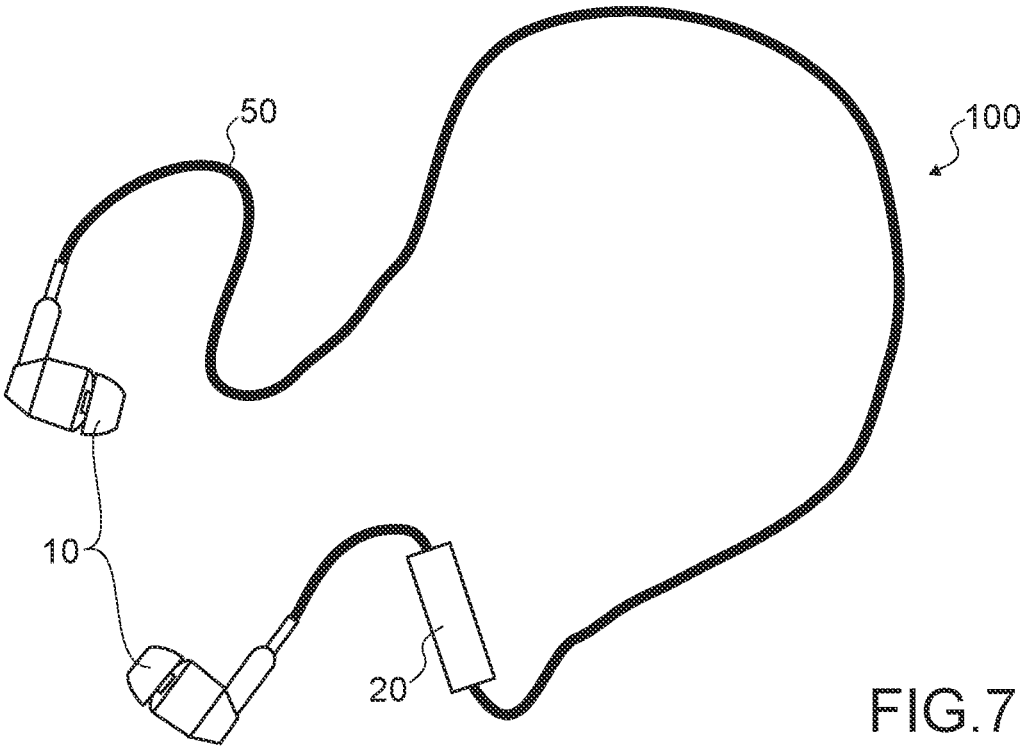
FIG. 7 A schematic view illustrating a still another configuration example of the acoustic device.

FIG. 6 and FIG. 7 are each a schematic view illustrating another configuration example of the acoustic device 100 of this embodiment. A configuration of the acoustic device 100 is not limited to the configuration illustrated in FIG. 1. For example, the acoustic device 100 may be configured to include the remote-control portion 20 not only between the earphone portion 10 and the main-unit portion 30, but also between, as illustrated in FIG. 6, the earphone portion 10 and the battery portion 40.

Alternatively, the acoustic device 100 may be configured to include, as illustrated in FIG. 7, only the earphone portion 10, the remote-control portion 20, and the cable 50. In this case, hardware necessary for the operations of the acoustic device 100, such as the CPU 301, the RAM 302, and the ROM 303, are provided in the earphone portion 10.

[Method for Controlling Acoustic Device]

Figure 8:
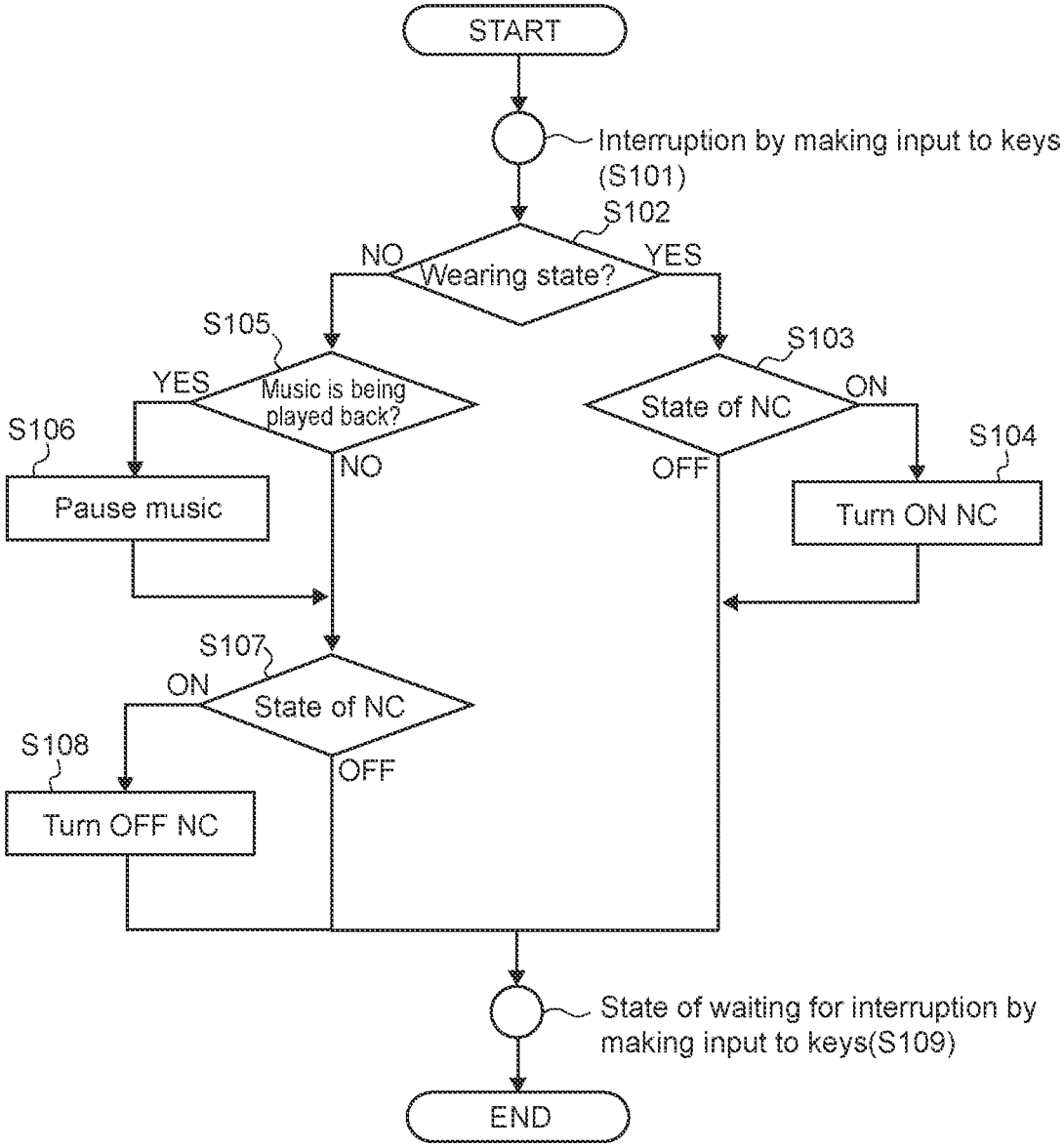
FIG. 8 A flowchart showing a typical operation procedure of the acoustic device FIG. 9 A view illustrating a wearing state in which the acoustic device is worn by the user.

FIG. 8 is a flowchart showing a typical operation procedure of the acoustic device 100. In addition, FIG. 9 is a view illustrating a wearing state in which the acoustic device 100 is worn by the user, and FIG. 10 is a view illustrating a non-wearing state in which the acoustic device 100 is not worn by the user.

In a method for controlling the acoustic device 100 according to this embodiment, various processes are triggered by an interruption process that is executed if voltage fluctuation via the A/D interface 304 occurs. Hereinbelow, with reference to FIG. 8 to FIG. 10 as appropriate, the method for controlling the acoustic device 100 is described.

In response to the input to the various keys (interruption) by the user (Step S101), the CPU 301 determines whether or not the acoustic device 100 is in the state of being worn by the user. Specifically, on the basis of whether or not the digital signal generated by converting the output voltage that is generated when the conduction between the power supply (VDD) and the ground is established in the tilt sensor 205 is acquired from the A/D interface 304, the CPU 301 determines whether the acoustic device 100 is in the wearing state of being worn by the user.

Specifically, if the digital signal from the A/D interface 304 is within a range of preset values (thresholds), the CPU 301 determines that the acoustic device 100 (earphone portion 10) is in the state of being worn by the user (refer to FIG. 9) (YES in Step S102). Then, in response to the key operation by the user, the CPU 301 implements the function (wearing function) based on the state via the Bluetooth (trademark) module 308.

In this embodiment, as the function to be implemented under the state in which the acoustic device 100 (earphone portion 10) is worn by the user, if the user has selected the NC function by making an input to the NC key 204 for switching the NC function (ON in Step S103), the NC function is implemented (Step S104). Note that, "State of NC (Noise Cancelling)" of Step S103 in FIG. 8 represents "State of NC that has been set in response to the key operation by the user," that is, does not represent how the NC is being implemented, but represents "Has the NC set by the user been turned ON or turned OFF?"

When the sound such as music or the like is played back by the acoustic device 100, first, sound containing noise is picked up by the microphones in the earphone portion 10. Then, this sound is converted to the digital signal by the Bluetooth (trademark) module 308 (hereinafter, referred to as a signal A).

Next, the radio waves received from the arbitrary device via the antenna 307 are converted to the digital signal (such as an audio signal) by the Bluetooth (trademark) module 308.

After that, the Bluetooth (trademark) module 308 calculates a difference between the signal A and a signal B (signal component except a signal component of the noise), thereby extracting the signal component of the noise, and generating a signal in a phase reverse to that of this signal (hereinafter, referred to as a signal C). Then, the Bluetooth (trademark) module 308 synthesizes the signal A and the signal C with each other. In this way, a digital signal in which the noise component of the signal A has been cancelled is generated. In other words, sound from which the noise is eliminated is played back. This enables the user to listen to sound from which the noise is removed, and to have a realistic sense of immersion.

Note that, in this embodiment, even when the CPU 301 determines that the acoustic device 100 (earphone portion 10) is in the state of being worn by the user, if the user has not selected the NC function by making the input to the NC key 204 for switching the NC function (OFF in Step S103), the NC function is not implemented, and the procedure shifts to a state of waiting for the input to the various keys by the user (Step S109).

Meanwhile, if the digital signal from the A/D interface 304 is out of the range of the preset values (thresholds), the CPU 301 determines that the acoustic device 100 (earphone portion 10) is in the state of not being worn by the user (refer to FIG. 10), and implements the function based on this state (non-wearing function).

In this embodiment, as the function to be implemented under the state in which the acoustic device 100 (earphone portion 10) is not worn by the user, an energy-saving function is implemented. By this energy-saving function, for example, if the music is being played back by the acoustic device 100 (YES in Step S105), this music is paused (Step S106). This prevents the music from being played back under the state in which the acoustic device 100 (earphone portion 10) is not worn by the user. Thus, power consumption can be reduced.

Then, for example, if the NC function has been selected (ON in Step S107) in response to the key operations by the user, the above-described NC function is implemented, and if the NC function has not been selected (OFF in Step S107) in response to the key operations by the user, the procedure shifts to the state of waiting for the input to the various keys by the user (Step S109). Note that, "State of NC (Noise Cancelling)" of Step S107 in FIG. 8 represents, similar to that of Step S103, "State of NC that has been set in response to the key operation by the user," that is, does not represent how the NC is being implemented, but represents "Has the NC set by the user been turned ON or turned OFF?"

Note that, in this embodiment, under the state in which the acoustic device 100 (earphone portion 10) is not worn by the user (NO in Step S102), even if the NC function has been selected, by not implementing the NC function (ON in Step S107), both the music playback and the NC function can be stopped. With this, power consumption can be further reduced.

[Functions]

In the acoustic device 100 of this embodiment, typically, the remote-control portion 20 includes the built-in tilt sensor 205. With this, a size of the earphone portion 10 can be reduced to be smaller than that in a case where the earphone portion 10 includes the built-in tilt sensor 205, and the number of wires (core wires) connecting the earphone portion 10 and the remote-control portion 20 to each other can be reduced. Thus, the acoustic device 100 can be configured even without increasing the number of components in the earphone portion 10.

In particular, the tilt sensor 205 has a simple structure of switching the conduction/insulation between the power supply (VDD) and the ground to each other by repeating the contact/separation of the built-in metal ball and the terminal in conjunction with the tilting of the tilt sensor 205 itself. With this, power need not be separately supplied to the tilt sensor 205 itself that detects the state of the acoustic device 100. Thus, power consumption and the number of wires (core wires) can be reduced to be smaller than those in utilizing other sensors.

In addition, in this embodiment, the remote-control portion 20 is provided at the position near the earphone portion 10 (refer to FIG. 1 and FIG. 9). With this, a movable range of the remote-control portion 20 in switching the wearing state (refer to FIG. 9) and the non-wearing state (refer to FIG. 10) of the acoustic device 100 (earphone portion 10) is expanded. In accordance therewith, a movable range of the tilt sensor 205 is also expanded. Thus, whether the acoustic device 100 (earphone portion 10) is in the wearing state or in the non-wearing state can be clearly distinguished. As a result, false detection of the state of the acoustic device 100 (earphone portion 10) is suppressed.

<Modifications>

As a matter of course, the present technology is not limited to the embodiment described hereinabove, and may be changed as appropriate.

For example, the music playback need not necessarily be paused by the energy-saving function as in the embodiment described hereinabove. A call may be hung up if the CPU 301 determines that the acoustic device 100 (earphone portion 10) is in the non-wearing state.

Further, unlike the embodiment that is described hereinabove on a premise that the acoustic device 100 is the Bluetooth (trademark) earphones, the present technology is applicable to other acoustic devices such as headphones, and its use purpose is not limited in particular.

Still further, the NC function need not be implemented in response to the key operation by the user as in the embodiment described hereinabove. The NC function may be automatically implemented/stopped in accordance with the wearing states of the acoustic device 100 (earphone portion 10).

Note that, the present technology may also employ the following configurations.

(1) An acoustic device, including:

an operating portion that generates information for determining whether a state of an earphone portion is a wearing state in which the earphone portion is worn by the user, or a non-wearing state in which the earphone portion is not worn by the user; and a control unit that determines whether the earphone portion is in the wearing state or in the non-wearing state on a basis of output from the operating portion, and that implements a function based on a result of the determination.

(2) The acoustic device according to (1), in which the control unit implements, in accordance with a determined one of the wearing state and the non-wearing state of the earphone portion, a wearing function in the wearing state, and a non-wearing function in the non-wearing state.

(3) The acoustic device according to (2), in which the control unit implements a noise cancelling function as the wearing function.

(4) The acoustic device according to (2) or (3), in which the control unit implements an energy-saving function as the non-wearing function.

(5) The acoustic device according to any one of (1) to (4), in which the operating portion includes a detection unit for determining whether the earphone portion is in the wearing state or in the non-wearing state.

(6) The acoustic device according to any one of (1) to (5), in which the operating portion is provided at a position near the earphone portion.

(7) The acoustic device according to (5) or (6), in which the operating portion includes a tilt sensor as the detection unit.

(8) A method for controlling an acoustic device, the method including:

determining whether a state of an earphone portion is a wearing state in which the earphone portion is worn by the user, or a non-wearing state in which the earphone portion is not worn by the user; and implementing, in accordance with a determined one of the wearing state and the non-wearing state of the earphone portion, a wearing function in the wearing state, and a non-wearing function in the non-wearing state.

REFERENCE SIGNS LIST

10 earphone portion
20 remote-control portion (operating portion)
100 acoustic device
301 CPU (control unit)
205 tilt sensor (detection unit)
208 resistive divider (analog circuit)

The invention claimed is:

1. An acoustic device, comprising:

an operating portion configured to generate information for determination of whether a state of an earphone portion is a wearing state in which the earphone portion is worn by a user, or a non-wearing state in which the earphone portion is not worn by the user, wherein the operating portion includes a tilt sensor to detect whether the earphone portion is in the wearing state or in the non-wearing state; and a circuitry configured to:

acquire a signal from the tilt sensor, via an analog/digital (A/D) interface coupled to the tilt sensor;

determine whether the acquired signal is within a range of preset values;

determine the earphone portion is in the wearing state based on the determination that the acquired signal is within the range of the preset values; and implement a function based on a result of the determination that the earphone portion is in the wearing state.

2. The acoustic device according to claim 1, wherein the circuitry is further configured to implement, in accordance with one of the wearing state and the non-wearing state of the earphone portion;

a wearing function in the wearing state, and a non-wearing function in the non-wearing state.

3. The acoustic device according to claim 2, wherein the circuitry is further configured to implement a noise cancelling function as the wearing function.

4. The acoustic device according to claim 2, wherein the circuitry is further configured to implement an energy-saving function as the non-wearing function.

5. The acoustic device according to claim 1, wherein the operating portion is provided at a position near the earphone portion.

6. The acoustic device according to claim 1, wherein the circuitry is further configured to determine that the earphone portion is in the non-wearing state based on the determination that the acquired signal is out of the range of the preset values.

7. The acoustic device according to claim 1, wherein the tilt sensor comprises a one-directional tilt type.

8. A method for controlling an acoustic device, the method comprising:

in the acoustic device that includes an operating portion:

acquiring a signal from a tilt sensor included in the operating portion, via an analog/digital (A/D) interface coupled to the tilt sensor;

determining whether the acquired signal is within a range of preset values;

determining, based on the determination that the acquired signal is within the range of the preset values, an earphone portion is in a wearing state in which the earphone portion is worn by a user; and implementing, based on a result of the determination that the earphone portion is in the wearing state, a wearing function in the wearing state.

* * * * *